US008121508B2

(12) United States Patent
Hasegawa et al.

(10) Patent No.: US 8,121,508 B2
(45) Date of Patent: Feb. 21, 2012

(54) IMAGE FORMING APPARATUS AND IMAGE FORMING METHOD

(75) Inventors: Satoshi Hasegawa, Toyokawa (JP); Masazumi Ito, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 458 days.

(21) Appl. No.: 12/362,187

(22) Filed: Jan. 29, 2009

(65) Prior Publication Data

US 2009/0317102 A1 Dec. 24, 2009

(30) Foreign Application Priority Data

Jun. 20, 2008 (JP) ..... 2008-161646

(51) Int. Cl.
*G03G 15/20* (2006.01)

(52) U.S. Cl. ..... 399/68; 399/69; 399/70

(58) Field of Classification Search ..... 399/68–70
See application file for complete search history.

(56) References Cited

U.S. PATENT DOCUMENTS

| | | | | |
|---|---|---|---|---|
| 6,099,181 | A | 8/2000 | Kitabatake | |
| 2006/0216052 | A1 * | 9/2006 | Bartley et al. | 399/70 |

FOREIGN PATENT DOCUMENTS

| | | |
|---|---|---|
| JP | 05-035150 | 2/1993 |
| JP | 8-76636 | 3/1996 |
| JP | 11-296046 | 10/1999 |
| JP | 2007-193241 | 8/2007 |
| JP | 2007-233073 | 9/2007 |

OTHER PUBLICATIONS

English Translation of JP 08-076636 to Yano.*
English Translation of JP 2007-193241 to Suzuki.*
English Translation of JP 11-296046 to Kitahata.*
English Translation of JP 2007-233073 to Hatano.*
Japanese Notification of Reasons for Refusal mailed Apr. 20, 2010, directed towards corresponding Japanese Patent Application No. 2008-161646; 6 pages.

* cited by examiner

*Primary Examiner* — Ryan Walsh
(74) *Attorney, Agent, or Firm* — Morrison & Foerster LLP

(57) ABSTRACT

The image forming apparatus includes: an image former which, upon receiving a first instruction, feeds a sheet and performs an image forming operation to form an image on the sheet; a fixing part which (i) secures a fixing nip by bringing outer circumferential surfaces of first and second rotating bodies into contact with each other, (ii) upon receiving a second instruction, heats the first and second rotating bodies until a temperature thereof reaches a target temperature, and (iii) thermally fixes the image onto the sheet passing through the fixing nip; and a determiner which determines output timings of the first and second instructions such that a timing at which a leading end, in a sheet convey direction, of the image formed on the sheet reaches the fixing nip and a timing at which the temperature of the first and second rotating bodies reaches the target temperature match each other.

18 Claims, 11 Drawing Sheets

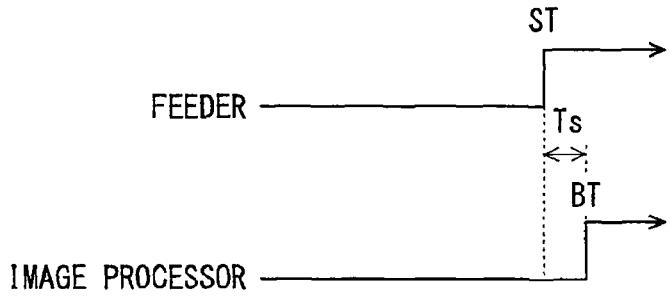
FIG. 10
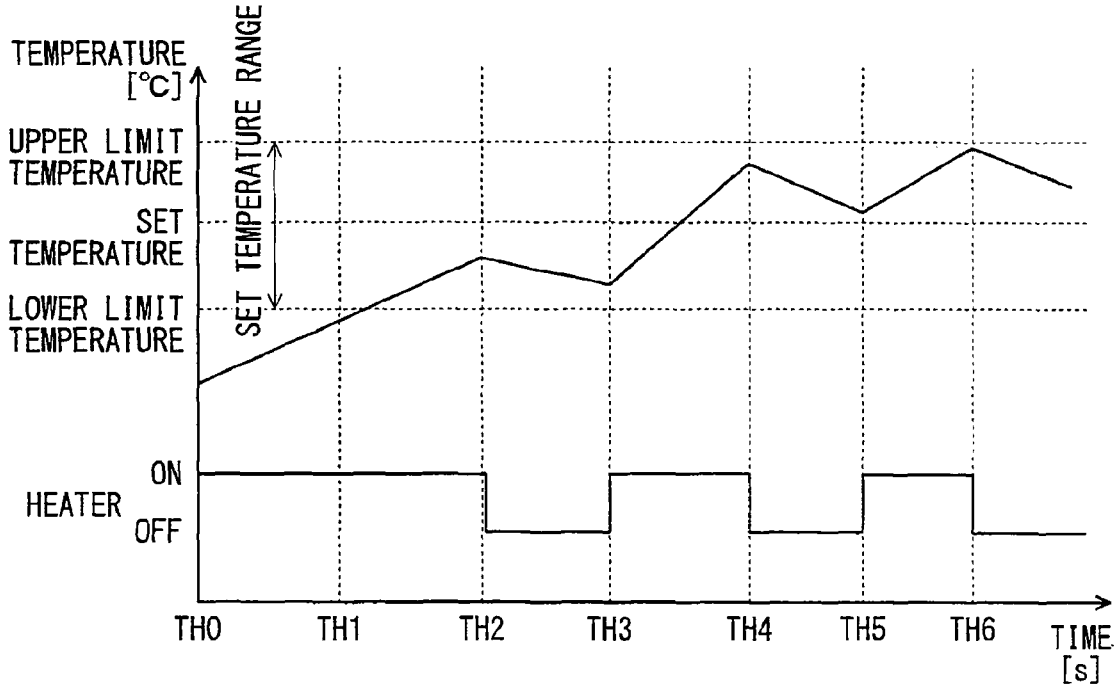

IMAGE FORMING APPARATUS AND IMAGE FORMING METHOD

This application is based on application No. 2008-161646 filed in Japan, the content of which is hereby incorporated by references.

BACKGROUND OF THE INVENTION (1) Field of the Invention

The present invention relates to an image forming apparatus and an image forming method, in particular to a technique for reducing power consumption and first print time.

(2) Related Art

For image forming apparatuses such as printers, conventionally, a reduction in the so-called first print time, which is a period of time from the input of a print instruction by a user to the discharge of the printed recording sheet, and a reduction in power consumption have been demanded in viewpoint of improved user convenience and energy saving. In response, a considerable number of techniques have been proposed to meet these needs.

For example, one structure of a fixing part which fixes an unfixed image formed on a recording sheet to the recording sheet by heat and pressure, secures a fixing nip by pressing a heater against a pressure roller across the fixing belt, maintains the heater OFF until receiving a print instruction, and upon receiving the instruction, starts raising the temperature of the heater and starts performing print operations at the same time. With this structure, the temperature of the fixing nip can be instantly raised to the fixing temperature required to fix unfixed images, and consequently, the first print time can be shortened compared to the structure which takes time to raise the temperature of the fixing nip, and the power consumption can also be reduced compared to the structure which applies power to the heater to maintain a predetermined standby temperature until receiving a print instruction.

Another known structure, although maintaining the fixing nip at the standby temperature until receiving a print instruction, calculates, upon receiving the instruction, an estimated temperature rise time required for the fixing nip to reach the fixing temperature from the standby temperature, and an estimated fixing nip arrival time required, from the start of the sheet feed from a sheet feed tray, for the leading end of the sheet to reach the entrance of the fixing nip, and controls operations of each part such that the timing at which the leading end of the recording sheet reaches the entrance of the fixing nip and the timing at which the temperature of the fixing nip reaches the fixing temperature coincide with each other.

Without such a control, for example, in a case where the estimated temperature rise time is very short and thus the fixing nip immediately reaches the fixing temperature, if the heater is turned ON simultaneously with the start of the feeding of the recording sheet, the temperature of the fixing nip reaches the fixing temperature before the leading end of the recording sheet reaches the fixing nip, causing the heater to be kept ON to wastefully maintain the temperature of the fixing nip at the fixing temperature during the time which is required for the leading end of the recording sheet to reach the fixing nip and is irrelevant to the fixing. On the other hand, as described above, by performing the control which allows the timing at which the leading end of the recording sheet reaches the entrance of the fixing nip and the timing at which the temperature of the fixing nip reaches the fixing temperature to match each other, application of power to the heater becomes unnecessary during the time irrelevant to the fixing, and the power consumption can be suppressed accordingly.

However, even if the above-described control for matching the timings is performed, when the recording sheet includes a portion without a formed image, that is to say, a non-image area from the leading end, in the recording sheet convey direction, of the recording sheet to the leading end of the image-formed area, the non-image area is also heated by the fixing temperature. This causes the wasteful consumption of power due to heating the non-image area, which is not required to be heated in the first place, at the fixing temperature.

SUMMARY OF THE INVENTION

The present invention was conceived in view of the above problem and aims to provide an image forming apparatus and an image forming method able to reduce power consumption.

The stated aim is achieved by an image forming apparatus comprising: an image former operable to, upon receiving a first instruction, feed a sheet and perform an image forming operation so as to form an image on the fed sheet; a fixing part operable to (i) secure a fixing nip by bringing an outer circumferential surface of a first rotating body and an outer circumferential surface of a second rotating body into contact with each other, (ii) upon receiving a second instruction, heat at least one of the first and second rotating bodies until a temperature of the first and second rotating bodies reaches a target temperature required for image-fixing, and (iii) thermally fix the image onto the sheet passing through the fixing nip; and a determiner operable to determine an output timing of the first instruction and an output timing of the second instruction such that a timing at which a leading end, in a sheet convey direction, of the image formed on the sheet reaches the fixing nip and a timing at which the temperature of the first and second rotating bodies reaches the target temperature match each other. The stated aim is also achieved by an image forming method executed by an image forming apparatus including an image former and a fixing part which secures a fixing nip by bringing an outer circumferential surface of a first rotating body and an outer circumferential surface of a second rotating body into contact with each other and thermally fixes an image onto a sheet passing the through the fixing nip. Here, the image forming method comprises: an image forming step of, upon receiving a first instruction, feeding a sheet and performing an image forming operation so as to form the image on the fed sheet; a temperature raising step of, upon receiving a second instruction, heating the first and second rotating bodies using the heater until a temperature of the first and second rotating bodies reaches a target temperature required for image-fixing; and a determining step of determining an output timing of the first instruction and an output timing of the second instruction such that a timing at which a leading end, in a sheet convey direction, of the image formed on the sheet reaches the fixing nip and a timing at which a temperature of the first and second rotating bodies reaches the target temperature match each other.

With the stated structure, the image forming apparatus can determine the output timing of the first instruction and the output timing of the second instruction in a manner that the timing at which the leading end, in the sheet convey direction, of the image formed on the sheet reaches the fixing nip and the timing at which the temperature of the first and second rotating bodies reaches the target temperature required for image-fixing match each other. Consequently, compared to the structure where the timing at which the temperature of the fixing nip reaches the fixing temperature and the timing at which the leading end of the sheet in the sheet convey direction reaches the fixing nip match each other, power consumption can be reduced, since it is not necessary to heat the non-image area from the leading end of the sheet in the sheet convey direction to the leading end of the image.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 9 is a timing chart showing relationship between a sheet feed start timing and an image formation start timing;

FIG. 10 is a diagram presenting both a characteristic diagram showing temperature change of the fixing nip according to a hysteresis temperature control, and a timing chart showing ON-OFF timing of a heater, of the first embodiment;

DESCRIPTION OF THE PREFERRED EMBODIMENT

The following describes embodiments of an image forming apparatus and an image forming method of the present invention by way of example of a tandem-type color digital printer (hereinafter, referred to as simply "printer").

First Embodiment

Figure 1:
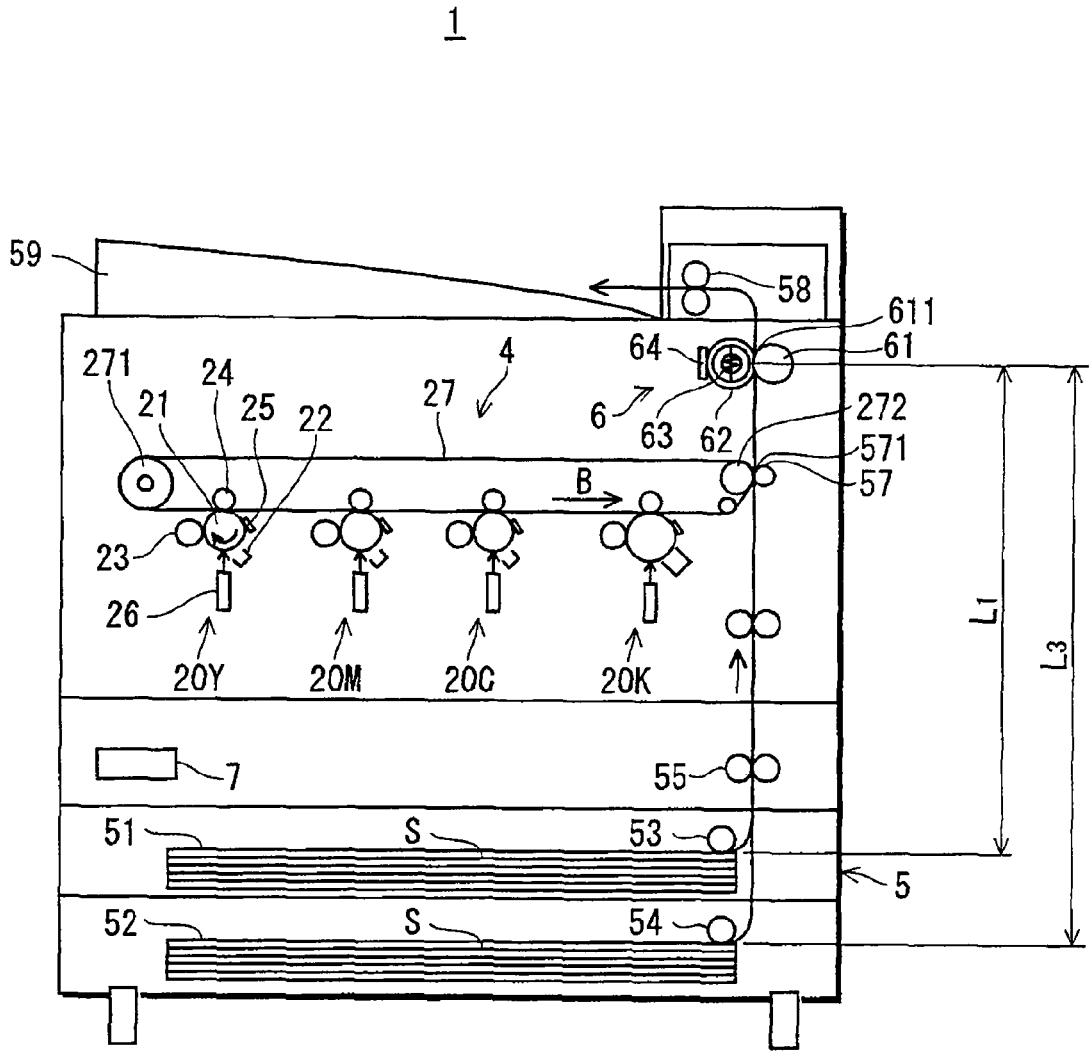
FIG. 1 is a cross-sectional view schematically showing a structure of a printer of a first embodiment.

As shown in FIG. 1, a printer 1 which executes image formation using a known electrographic system or the like includes an image processing unit 4, a feeder 5, a fixing part 6, and a controller 7. The printer 1 is connected to a network such as a LAN, and upon receiving a print job execution instruction from an external terminal apparatus (not depicted), executes color image formation in accordance with the instruction, the color image being composed of colors yellow, magenta, cyan, and black. The yellow, magenta, cyan and black reproduction colors are hereinafter represented as Y, M, C, and K respectively, and the letters Y, M, C, and K are appended to numbers pertaining to the reproduction colors.

The image processing unit 4 includes image forming units 20Y, 20M, 20C, and 20K corresponding to the colors Y to K respectively, and an intermediate transfer belt 27.

The intermediate transfer belt 27 is an endless belt that is suspended in a tensioned state on a driving roller 271 and a driven roller 272, and is rotated in the direction of arrow B. At a secondary transfer position 571, A secondary transfer roller 57 is positioned opposing the driven roller 272 across the intermediary transfer belt 27.

The image forming units 20Y, 20M, 20C, and 20K are positioned in series facing the intermediary transfer belt 27 and along the moving direction of the belt from the upstream side to the downstream side at a predetermined interval. The image forming unit 20Y includes an image carrier such as a photosensitive drum 21, and in a vicinity thereof, includes a charger 22, a developer 23, a primary transfer roller 24 opposing the photosensitive drum 21 across the intermediary transfer belt 27, a cleaner 25, a print head 26, and the like, and forms a toner image in the color of Y on the circumferential surface of the photosensitive drum 21Y. Other image forming units 20M to 20K also have similar structure to the image forming unit 20Y, and reference numbers thereof are omitted.

The feeder 5 includes sheet feed trays 51 and 52 accommodating sheets S, feeding rollers 53 and 54 which feed the sheets S from the sheet feed trays 51 and 52, respectively, one sheet at a time, and a conveying roller pair 55 for conveying the fed sheets S. The sheet feed trays 51 and 52 can be set for various kinds of sheets S differing in size and thickness (basis weight), and the sheets S selected by the print job execution instruction are supplied therefrom. The sheet feed trays 51 and 52 can also accommodate other kinds of recording sheets such as OHP.

The fixing part 6 includes a pressure roller 61, a fixing roller 62, a heater 63, a temperature sensor 64, and the like. The pressure roller 61 is pressed against the fixing roller 62 which is heated by the heater 63, so as to secure a fixing nip 611. The temperature of the fixing nip 611 can be controlled by changing the quantity of heat of the heater 63, and in the present embodiment, a control is performed to switch the temperature between a standby temperature and a fixing temperature. Here, the fixing temperature as a target temperature is a temperature required to fix an unfixed image transferred onto the sheet S. On the other hand, the standby temperature is a temperature set to be lower than the fixing temperature by a certain degree for the purpose of power saving, and the temperature of the fixing nip 611 is maintained at the standby temperature between completion of warm-up of the fixing part 6 and start of a print operation, or between completion of a print operation and start of the next print operation. The fixing temperature and standby temperature are determined in advance.

The controller 7 converts an image signal from the external terminal apparatus into digital signals for colors Y to K, and generates a driving signal for driving the luminous element of the print head 26.

In accordance with a driving signal from the controller 7, the print head 26 emits the laser beam L for image formation in colors Y to K, and scans the laser beams across the photoreceptor drums 21Y to 21K. This exposure scanning forms electrostatic latent images on the photoreceptor drums 21Y to 21K that have been uniformly charged by the chargers 22Y to 22K. The electrostatic latent images are developed by the developers 23Y to 23K with use of the toner, and toner images of colors Y to K are formed on the photoreceptor drums 21Y to 21K.

The color toner images are sequentially transferred to the outer circumferential surface of the intermediate transfer belt 27 by electrostatic power acting on the primary transfer rollers 24Y to 24K. At this time, the image forming operation for each color is executed at different timings so that the toner images are superimposed on the same position on the intermediate transfer belt 27. The toner images for each color that have been superimposed on the intermediate transfer belt 27 are transported by the rotation of the intermediate transfer belt 27 to the secondary transfer position 571.

Meanwhile, the sheet S is fed from the feeder 5 via the convey roller pair 55 at the timing of transport by the intermediate transfer belt 27. The sheet S is conveyed sandwiched between the rotationally driven intermediate transfer belt 27 and the rotating secondary transfer roller 57. The toner images on the intermediate transfer belt 27 are collectively secondarily transferred to the sheet S by electrostatic power acting on the secondary roller 57.

The sheet S that has passed the secondary transfer position 571 is conveyed to the fixing part 6. As a result of the sheet S passing the fixing nip 611 of the fixing part 6, the toner images on the sheet S (unfixed images) are fixed thereto by heat and pressure, and the sheet S is discharged to the discharge tray 59 via a discharge roller pair 58.

<Structure of Controller 7>

Figure 2:
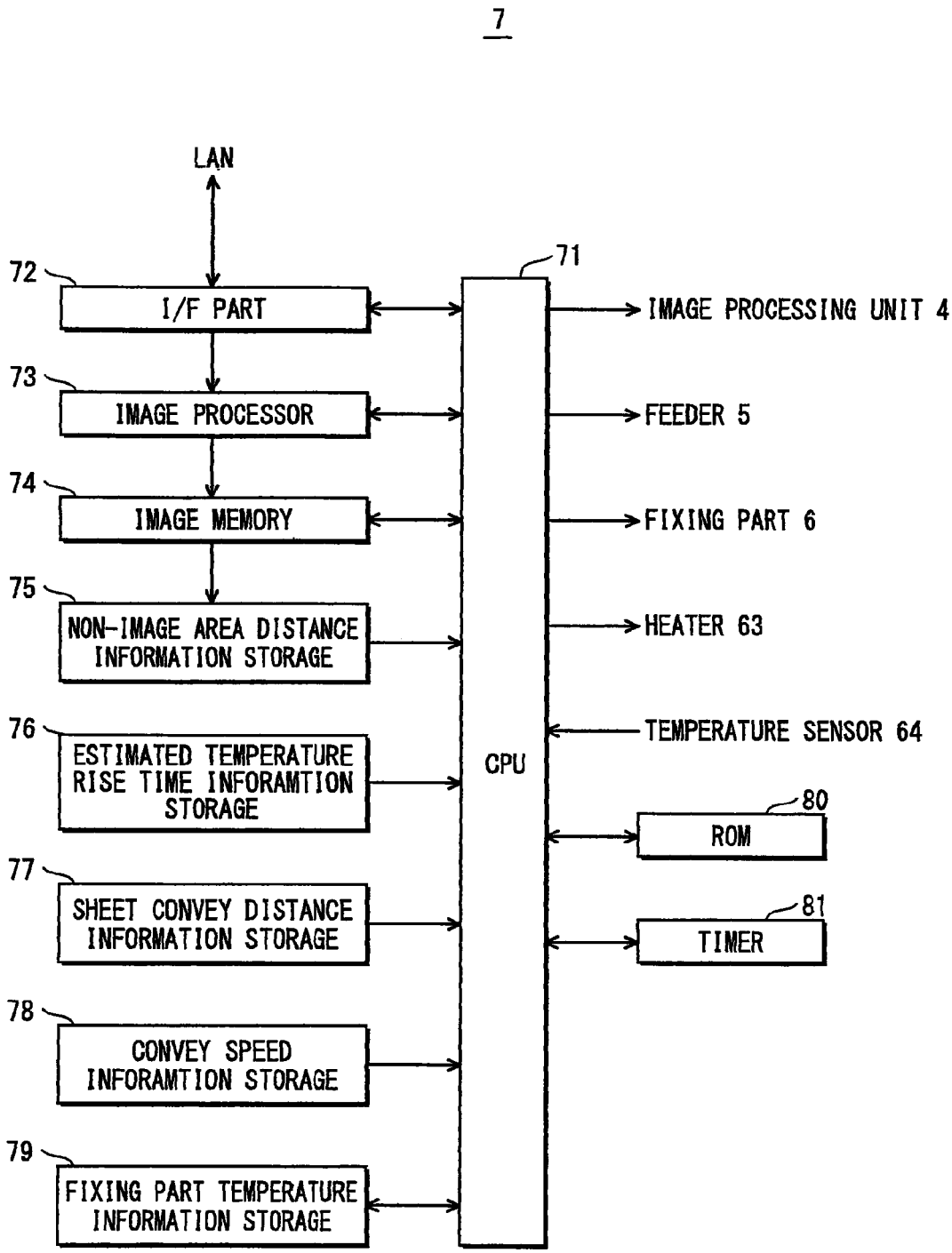
FIG. 2 is a block diagram showing a structure of a controller of the first embodiment.

As shown in FIG. 2, the controller 7 includes a CPU 71, a communication interface (I/F) part 72, an image processor 73, an image memory 74, a non-image area distance information storage 75, an estimated temperature rise time information storage 76, a sheet convey distance information storage 77, a convey speed information storage 78, a fixing part temperature information storage 79, a ROM 80, a timer 81, and the like as major structural components.

The communication I/F part 72 which is an interface for connecting to a LAN such as a LAN card or a LAN board receives an image signal from the external terminal device and transmits the received image signal to the image processor 73.

The image processor 73 converts the image signal received from the communication I/F part 72, in units of pages, to image data respectively corresponding to the production colors Y to K, and outputs the image data to the image memory 74 which stores the image data according to the respective colors.

The non-image area distance information storage 75 stores non-image area distance information indicating, on the assumption that an image has been printed on the sheet S, a distance, in the sheet-conveying direction, of a non-image area which is an area outside the formed image area on the sheet S selected in the print job execution instruction (hereinafter, this distance is referred to as "non-image area distance").

The non-image area is a blank area which is other than image areas composed of characters, diagrams, etc. on the sheet S. Here, the non-image area distance represents a distance, in the sheet-conveying direction, from the leading end of the sheet S to the leading end of the image.

The non-image area distance information is generated by the non-image area distance detection processing, which is described later, in units of pages for each print job. However, it is not limited this, and for example, in a case where information indicating a coordinate of the position of the leading end of the image area in the sheet-conveying direction is received along with the print job execution instruction from the external terminal via the communication I/F part 72, the non-image area distance information can be generated based on the coordinate information.

The estimated temperature rise time information storage 76 stores estimated temperature rise time information indicating an estimated temperature rise time TO required for the temperature of the fixing nip 611 of the fixing part 6 to rise from the standby temperature to the fixing temperature.

It should be noted that the standby temperature is controlled by a hysteresis temperature control, which is described later, so as to be maintained within a certain range of temperature with a base temperature as the central value of the range. Accordingly, the certain range of temperature is divided into a plurality of temperatures, and each of the plurality of temperatures is stored in association with a corresponding estimated temperature rise time T0.

The sheet convey distance information storage 77 stores (a) sheet convey distance information indicating sheet convey distances L1 and L3 (see FIG. 1) from sheet feed starting points, each of which is, for example, a position of the leading end of the sheet S at the time of starting the sheet feed, in a vicinity of the feeding rollers 53 and 54 to the entrance of the fixing nip 611 of the fixing part 6, respectively in one-to-one correspondence with (b) the corresponding sheet feeding trays 51 and 52. When the sheet convey distance information is read, it is judged, upon reception of the print job execution instruction, which of the sheet feeding trays 51 and 52 is used, and a piece of sheet convey distance information corresponding to whichever of the sheet feeding trays 51 and 52 to be used is read.

Here, although the sheet convey distances L1 and L3 are schematically shown as linear distances in FIG. 1, since sheet convey paths from the sheet starting points to the entrance of the fixing nip 611 are curved to some extent, the sheet convey distances L1 and L3 actually indicate distances along the curved paths. The same can be said for the convey distances.

The convey speed information storage 78 stores convey speed information indicating a convey speed V which is determined in advance based on the kind of the sheet S. The convey speed V is, for example, set to 144 [mm/s] for a plain sheet of A4 size, and set to 72 [mm/s] for a thick sheet of the same size. Additionally, for a so-called long sheet, the convey speed V is set to a speed slower than the speed for plain sheet.

The fixing part temperature information storage 79 temporarily, in the hysteresis temperature control which is to be described later, stores temperature information indicating the temperature of the fixing part 6, which is sampled by the temperature sensor 64 at a predetermined interval, and overwrites the stored temperature information with the temperature information indicating the newly sampled temperature.

The timer 81 is used to measure the elapsed time after the temperature of the fixing part 6 starts rising during the sheet feed control of the sheet S, which is described later.

The ROM 80 stores a control program related to image forming operations, a sheet feed control processing program (to be described later), and the like.

The CPU 71 reads necessary programs from the ROM 80 and causes execution of smooth print operations by uniformly controlling operations of the image processing unit 4, the feeder 5, the fixing part 6, etc., in accordance with appropriate timings. Also, the CPU 71 performs a control such that the temperature of the fixing nip 611 is maintained at the standby temperature until receiving the print job execution instruction, and upon receiving the print job execution instruction, executes a temperature control with respect to the fixing nip 611, which is described later.

Particularly, in the present embodiment, the temperature control of the fixing part 6 and the sheet feed control of the sheet S are executed as described in the following such that the timing at which the temperature of the fixing nip 611 secured at the fixing part 6 reaches the fixing temperature and the timing at which the leading end of an unfixed image formed on the sheet S reaches the entrance of the fixing nip 611 match each other.

<Temperature Control of Fixing Part 6>

Next, the temperature control of the fixing part 6 is described with reference to FIGS. 3 and 4.

Figure 3:
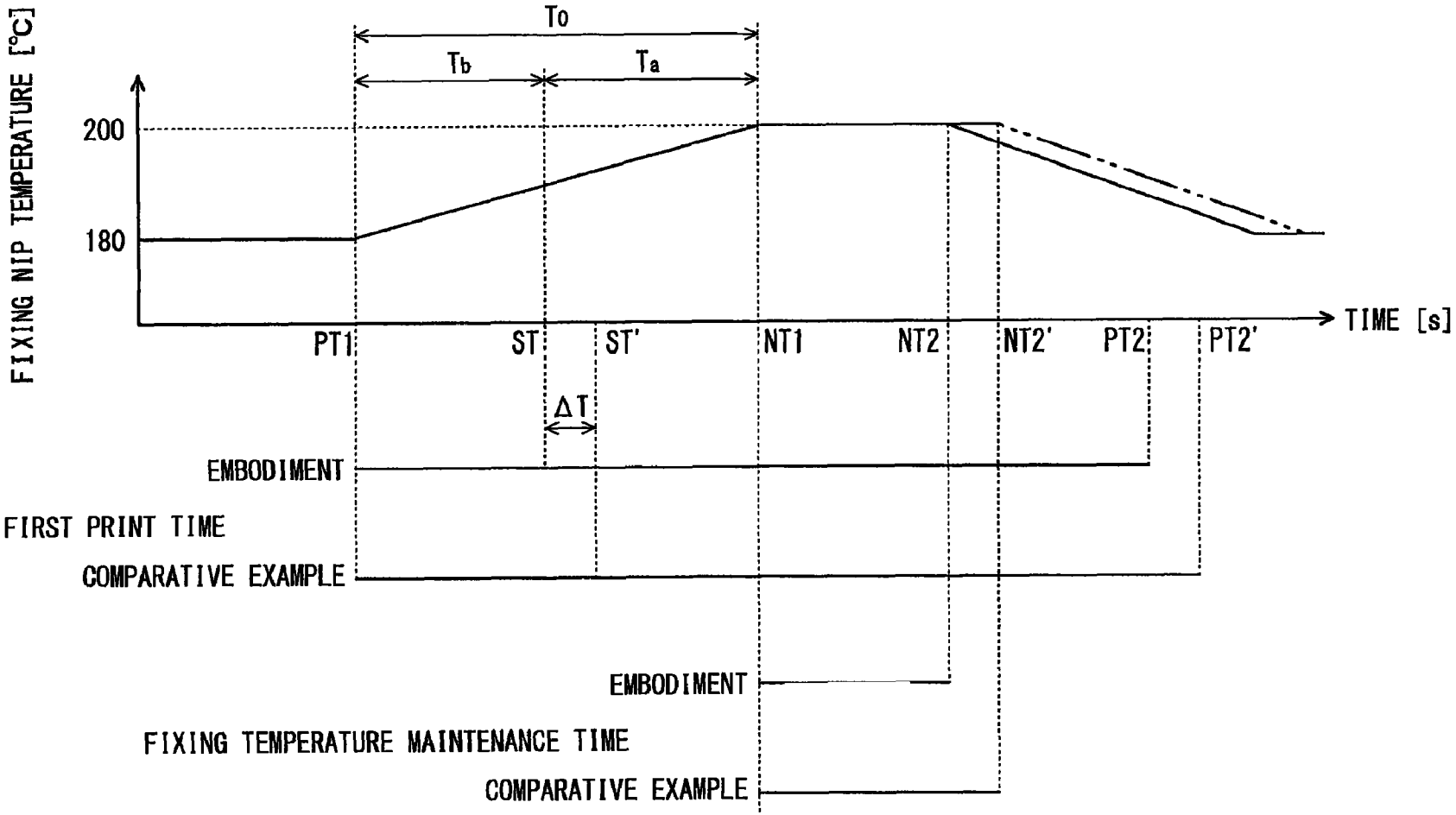
FIG. 3 shows temperature change of a fixing nip during a fixing part temperature control of the first embodiment.

The characteristic chart in FIG. 3 showing temperature change of the fixing nip 611 during the temperature control of the fixing part 6 indicates an example in which the printer 1 in standby mode is instructed to execute a print job. Here, PT1 denotes the timing at which the print execution instruction is received, NT1 denotes the timing at which the fixing nip 611 reaches the fixing temperature, and NT2 denotes the timing at which the sheet S exits from the fixing nip 611.

As shown in FIG. 3, prior to the timing PT1, the temperature of the fixing nip 61 is maintained at the standby temperature by the temperature control. Upon the reception of the print execution at the timing PT1, the temperature control of the fixing part 6 is executed such that the heater 63 is controlled to start heating the rollers 61 and 62 (the fixing nip 611) and to start, at the timing NT1, maintaining the temperature at the fixing temperature. The heater 63 is turned OFF at the timing NT2 to lower the temperature from the fixing temperature to the standby temperature, and turned on again upon the temperature reaching the standby temperature. After this, the temperature of the fixing nip 611 is maintained at the standby temperature by the temperature control.

In a section where the temperature of the fixing nip 611 is raised (the timings PT1 to NT1), a predetermined temperature control is executed to maximize the voltage applied to the heater 63 to raise the temperature of the fixing nip 611 at a certain rate. On the other hand, in sections where the temperature of the fixing nip 611 is maintained at the standby temperature or the fixing temperature (prior to PT1 and from NT1 to NT2), the hysteresis temperature control (to be described later) is executed.

Figure 4:
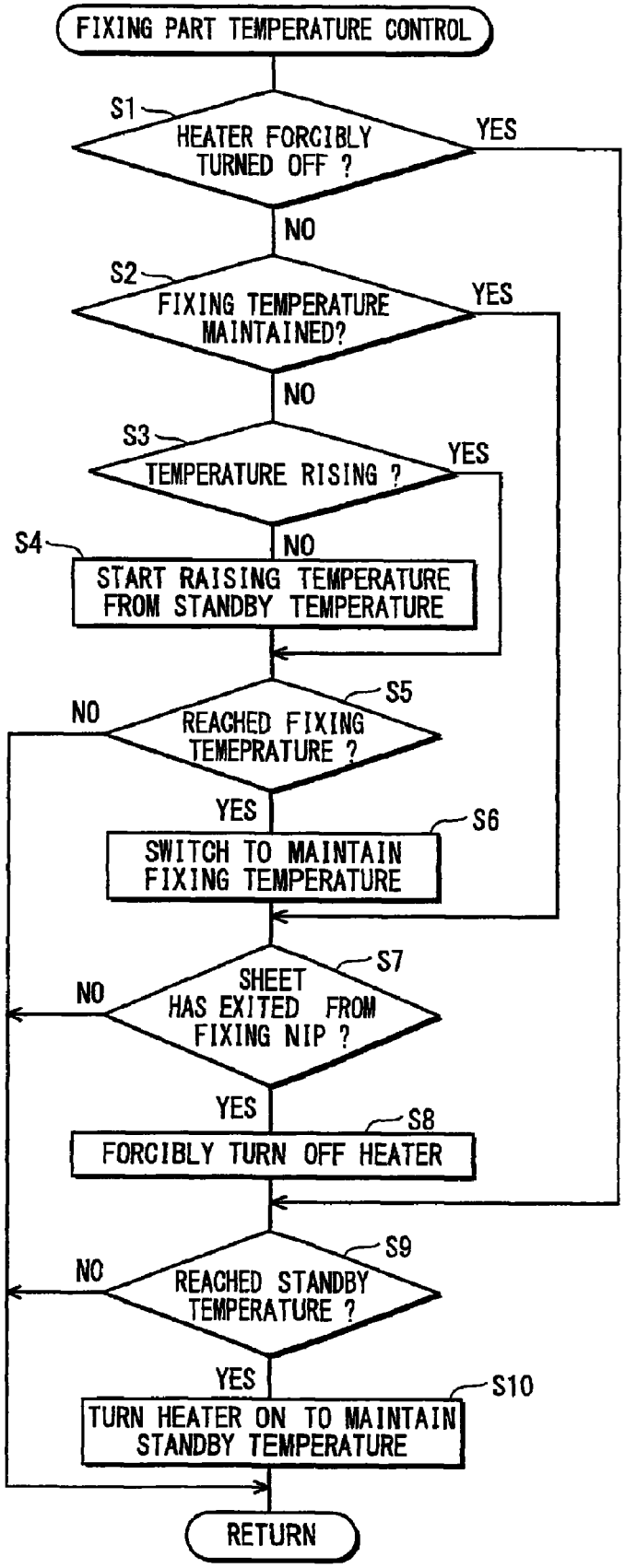
FIG. 4 is a flowchart showing an exemplary content of the fixing part temperature control of the first embodiment.

FIG. 4 is a flowchart showing an exemplary content of the temperature control of the fixing part 6, and the temperature control is, upon the reception of the print job, called by the main routine (not depicted) and executed.

First, judgement is made on whether the heater 63 is forced OFF or not (step S1), the fixing temperature is maintained or not (step S2), and the temperature of the fixing nip 611 is being raised or not (step S3). These states, namely, the heater 63 being forced OFF, the fixing temperature being maintained, and the temperature being raised relate to states after steps S4, S6, and S8, respectively, which are described later. Thus, here, the following description is given assuming that all these judgements are negative. Next, the temperature of the fixing nip 611 starts rising as a result of an instruction (second instruction) being given to the heater 63 to start raising the temperature (step S4) (timing PT1 in FIG. 3). After the temperature of the fixing nip 611 starts rising, it is judged whether the temperature has reached the fixing temperature or not by monitoring a detection signal from the temperature sensor 64 (see FIGS. 1 and 2) (step S5). If the temperature has not reached the fixing temperature (NO at the step S5), the main routine (not depicted) and the steps S3 and S5 in the present sub routine are repeated, thereby executing temperature raising operations until the temperature reaches the fixing temperature. Upon the temperature reaching the fixing temperature, which is 200 [° C.] here (YES at the step S5), the temperature control is switched to maintaining the temperature of the fixing nip 611 at the fixing temperature is started (step S6) (timing NT1 in FIG. 3). After switching, (a) if the sheet S is passing through the fixing nip 611 (NO at step S7), the temperature continues to be maintained at the fixing temperature, and (b) if the sheet S is judged to have exited from the fixing nip 611 (YES at step S7), the heater 63 is turned OFF forcibly (step S8) (timing NT2 in FIG. 3). After being turned OFF, the heater 63 is maintained at the OFF state during repetition of the step S1 to step S9 and return to the main routine. As a result, the temperature of the fixing nip 611 gradually lowers, and upon the temperature of the fixing nip 611 dropping to the standby temperature (YES at step S9), the heater 63 is turned ON again to maintain the temperature of the fixing nip 611 at the standby temperature (step S10).

In the above-described fixing part temperature control, it is to be noted that the heater 63 starts the temperature raising operations upon reception of a print job execution, and the timing at which the temperature of the fixing nip 611 reaches the fixing temperature and starts being maintained relates not to the timing at which the leading end of the sheet S reaches the fixing nip 611, but to the timing at which the leading end of the image formed on the sheet S reaches the fixing nip 611. The timing at which the fixing nip 611 reaches the fixing temperature and the timing at which the leading end of the image formed on the sheet S reaches the fixing nip 611 are adjusted by the sheet feed control (FIG. 6), which is described next.

<Sheet Feed Control of Sheet S>

Figure 5A:
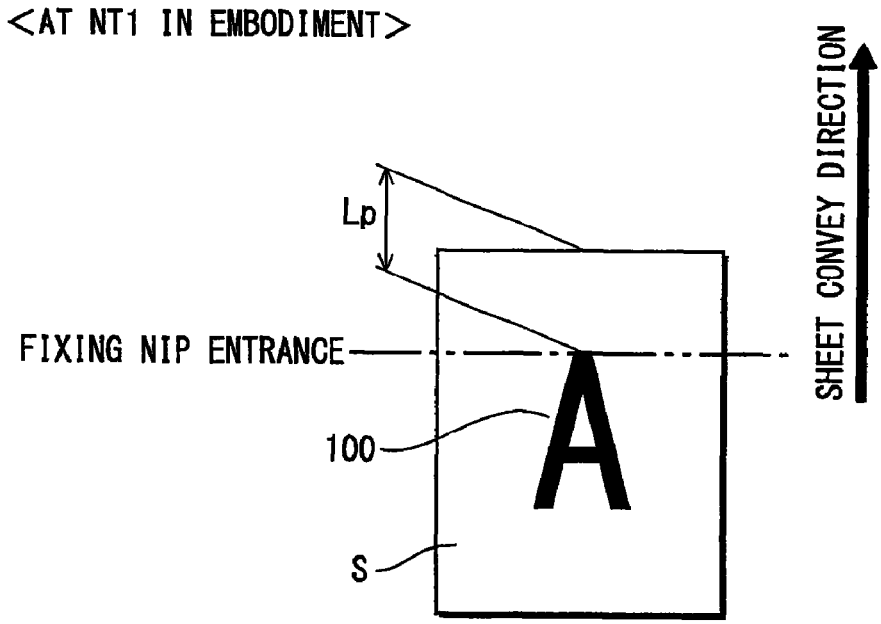
FIG. 5 schematically shows positional relationship between an entrance of the fixing nip and a sheet S which is conveyed.

As shown in the schematic diagram in FIG. 5A, the sheet feed control of the sheet S in accordance with the present embodiment controls start timing of the sheet feed such that the leading end of an unfixed image 100 reaches the entrance of the fixing nip 611 at the timing NT1. In the following, contents of the control are specifically described with reference to FIG. 6 showing an exemplary content of the sheet feed control.

Figure 6:
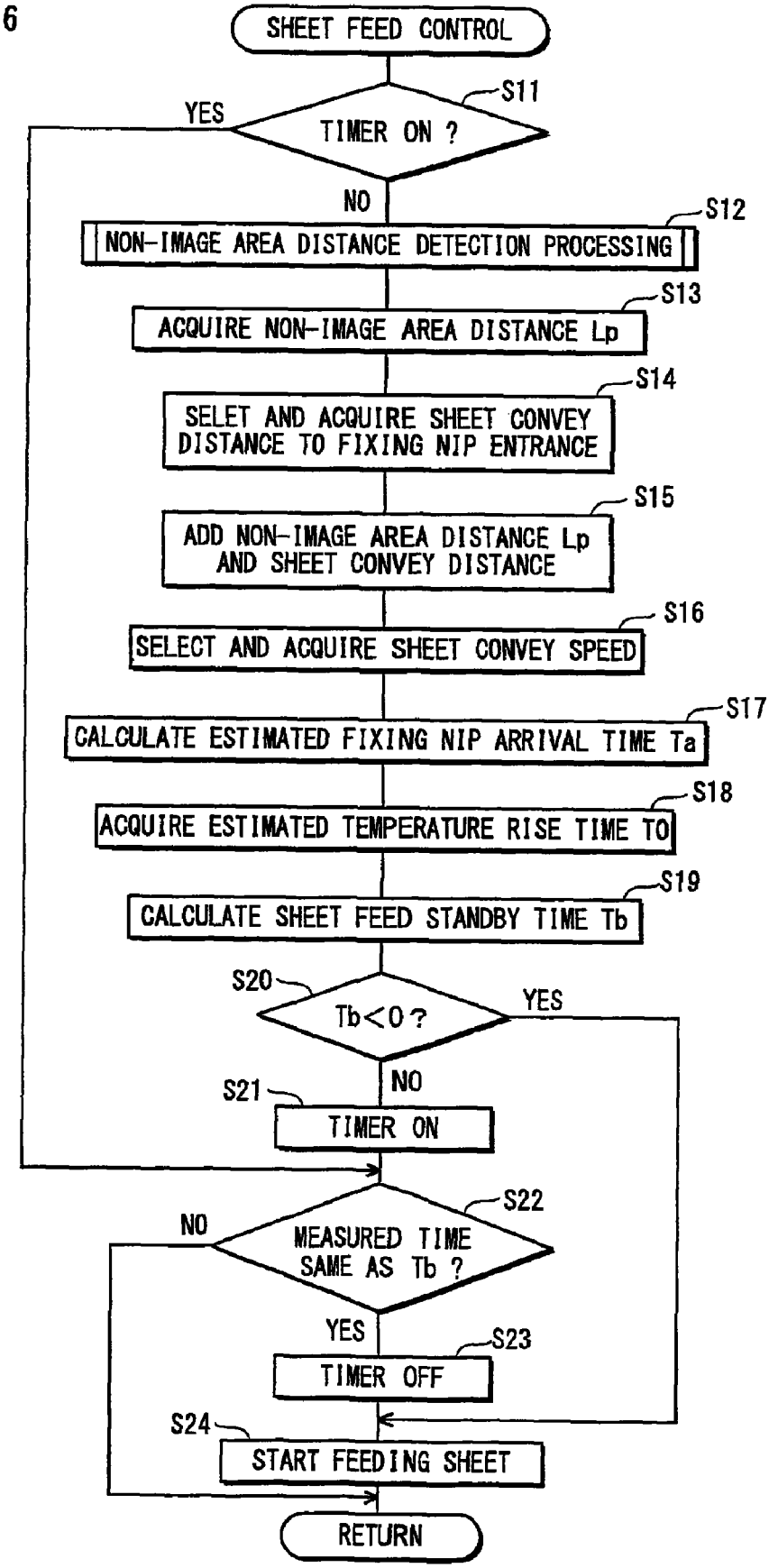
FIG. 6 is a flowchart showing an exemplary content of a sheet feed control of the first embodiment.

The sheet feed control shown in FIG. 6 is, upon the above-described fixing part temperature control being started, called from the main routine (not depicted) and executed.

First, it is judged whether the timer 81 is ON or not (step S11). The state of the timer 81 being ON relates to a state after step S21 (to be described later), and thus, the following description is given assuming that the judgement is negative. Next, the non-image area distance detection processing is executed (step S12).

In the non-image area detection processing, the non-image area distance is a distance, for every page of each job executed, from the leading end of the sheet on which the image is assumed to have been formed, to the leading end of the image, and in the example in FIG. 5A, corresponds to Lp.

In the following, the non-image area distance detection processing is described using FIGS. 7 and 8. Note that here, description is given on an example where the unfixed image 100 (see FIG. 5) is image data composed of the colors Y and K. Also, FIG. 8 schematically shows the image data of the example converted into bitmap in the colors Y and K, and indicates the shaded areas to be image areas.

Figure 7:
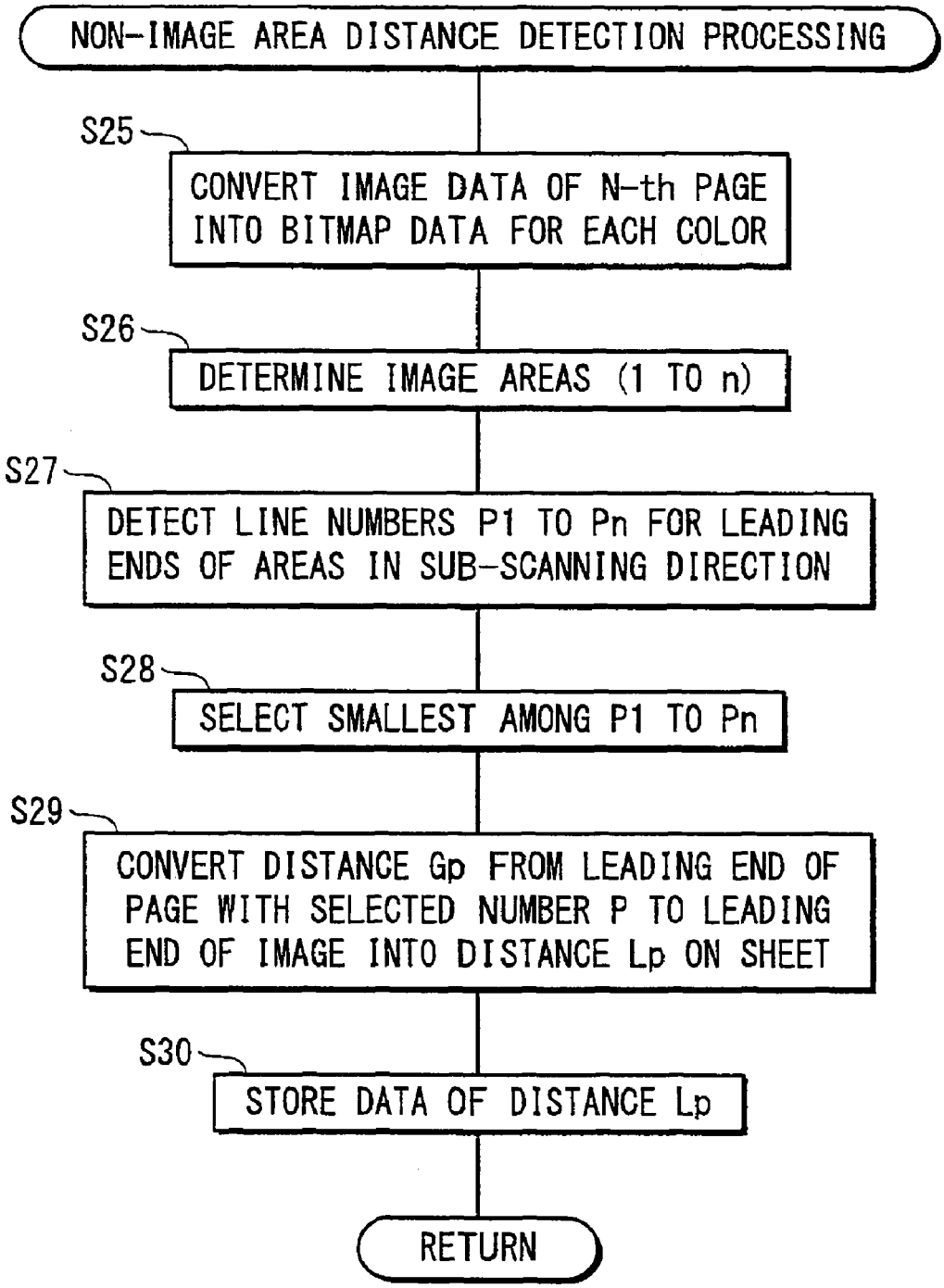
FIG. 7 is a flowchart showing an exemplary content of non-image area distance detection processing of the first embodiment.

First, as shown in FIG. 7, image data of the N-th page (N being an integer of one or more) is converted to bitmap data in the respective colors (step S25). This conversion may be performed in the image memory 74, or may be performed in a different RAM (not depicted).

The respective image data converted to bitmap are referred to, and image areas 1 to n (n being an integer of one or more) included therein are determined(step S26).

Figure 8:
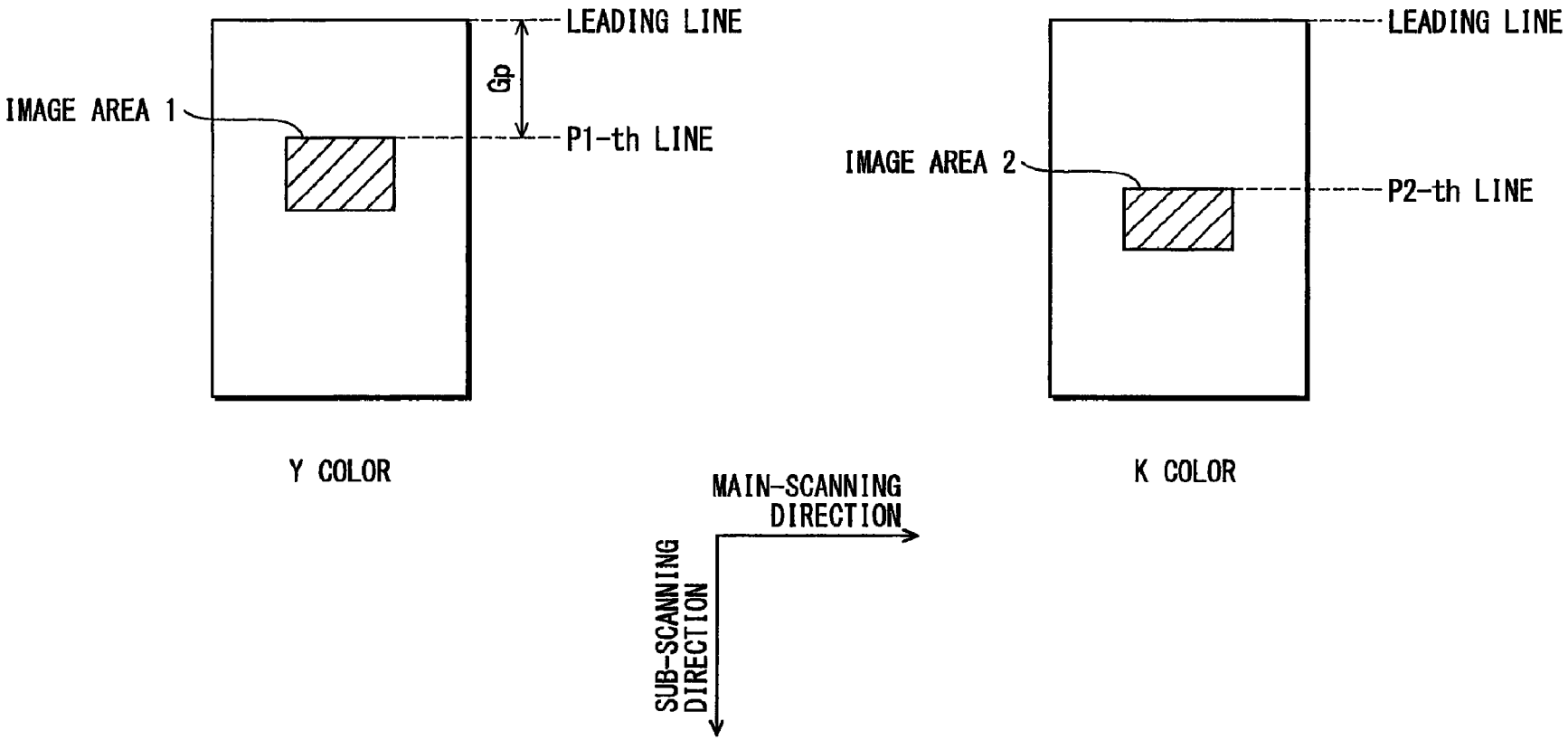
FIG. 8 schematically shows exemplary image data, of the first embodiment, converted into bitmap images, one in Y color and one in K color.

In the example shown in FIG. 8, areas 1 and 2 are determined to be the image areas for the colors Y and K, respectively. For other colors, an image area, if any exists, is determined in a similar manner as well. For the determination, for example, a known character area determination method or a determination method for photos or diagrams can be applied.

Next, a line number is detected for the leading end of each of the determined images in the sub-scanning direction in the order of determination (step S27). Here, line numbers P1 and P2 are detected for the image areas 1 and 2, respectively. Note that the line number is a number sequentially assigned to each line from the top of the page in the main-scanning direction of the exposure scanning.

Next, the smallest line number among the line numbers P1 to Pn is selected (step S28). Here, P1 is selected. A distance Gp from the leading end (leading line) of the page including the selected line number P1 to the leading end of the image area is converted to the non-image area distance Lp on the sheet (step S29).

This conversion can be performed, for example, by pre-storing, in the ROM or the like, information associating the value of each line number, starting from the leading line, with a corresponding distance on the sheet, and referring to the stored information.

Following that, data of the non-image area distance Lp is stored into the non-image area distance information storage 75 (see FIG. 2) (step S30).

It should be noted that as long as image areas and positions thereof can be determined for each page, a method other than the above-mentioned method, which converts the image data into bitmap data, can be used. For example, in a case where information required to determine the area, such as coordinate value data indicating the image area, can be obtained, the image area can be determined based on the coordinate value.

Referring back to FIG. 6, the non-image area distance Lp is acquired from the non-image area distance information storage 75 (step S13).

Of the sheet convey distances L1 and L3 (see FIG. 1) which respectively correspond to the sheet feed trays 51 and 52, the one accommodating the sheet S selected by the print job execution instruction is selected and acquired (step S14). Here, it is assumed that the distance L1 is selected. The non-image area distance Lp and the sheet convey distance L1 are added (step S15), thereby calculating the image convey distance La (=Lp+L1). In the case where the distance L3 is selected, L1 is replaced by L3.

The sheet convey speed V is selected and acquired according to the kind of the accommodated sheet S (step S16), and an estimated fixing nip arrival time Ta (see FIG. 3) is obtained by dividing the image convey distance La by the selected sheet convey speed V (step S17). Following that, the estimated temperature rise time T0 corresponding to the current temperature detected by the temperature sensor 64 is acquired by referring to the estimated temperature rise time information storage 76 (step S18).

The time Ta corresponds to a period of time required for the leading end of the image formed on the sheet S to reach the fixing nip 611, from the start of the feeding of the sheet S.

The estimated temperature rise time T0 is a period of time for the fixing nip 611, from the start of the temperature rise thereof, to reach the fixing temperature. Accordingly, by starting the feeding of the sheet S earlier, by the time Ta, than the timing NT1 which is the timing after a lapse of the time T0 upon the start of the temperature rise, the leading end of the unfixed image 100 can reach the entrance of the fixing nip 611 at the timing NT1, as shown in FIG. 5A.

In practice, the time Tb is calculated by subtracting the estimated fixing nip arrival time Ta from the estimated temperature rise time T0 (step S19), and the instruction to start the sheet feed (first instruction) is output to the feeder 5 upon a lapse of the time Tb after the timing PT1, to start the sheet feed.

When the sheet feed standby time Tb is judged not to be a negative value (NO at step S20), the timer 81 is turned ON (step S21), and a temperature rise time T3 of the fixing part 6 starts being measured. A case where the sheet feed standby time Tb is a negative value is described later. Here, processing of the steps S11 to S20 is executed by the CPU71 instantaneously, and thus, the timing at which the temperature of the fixing part 6 starts rising and the timing at which the timer is turned ON are substantially the same. Consequently, the time which has elapsed after the temperature of the fixing part 6 starts rising and the time actually measured by the timer 81 can be considered the same.

Next, it is judged whether the temperature rise time T3 which is being timed and the sheet feed standby time Tb are the same or not (step S22). When the judgement indicates negative (NO at a step S22), the routine returns to the main routine (not depicted), and the sheet feed control is called again. Since the timer 81 has been already turned ON, the timer is judged to be ON (YES at the step S11), and the steps S12 to S21 are skipped. It is judged again at the step S22 whether the temperature rise time T3 and the sheet feed standby time Tb are the same or not. When the judgement indicates positive (YES at the step S22), the timer 81 is turned OFF (step S23), and the sheet feed is started (step S24).

Described below is a case where a slower speed is selected as the convey speed V in accordance with the kind of the selected sheet S. For example, assuming that the time Ta shown in FIG. 3 is calculated using the sheet convey speed V corresponding to the plain sheet of A4 size, when the thick sheet of the same size is actually selected, the sheet convey speed V becomes half, as described above. As a result, in FIG. 3, a timing which is earlier than the timing NT1 by twice the time Ta comes earlier than the timing PT1, in calculation. Practically, feeding of the sheet S cannot be started prior to the timing PT1. In this case, the calculated feed sheet standby time Tb takes a negative value. When the time Tb is judged to be a negative value (YES at the step S20), as in the above case, the sheet feed is started immediately (step S24).

The image forming operation is started in conjunction with the start of the sheet feed as in the following.

That is to say, as shown in FIG. 9, the timing chart showing a relationship between the sheet feed start timing and image formation start timing indicates the sheet feed start timing as ST, and indicates that the image formation is started at a timing BT upon a lapse of a predetermined time Ts after the timing ST.

This predetermined time Ts is for adjusting the difference in operation time between the sheet feed operation and the image forming operation, and is predetermined in accordance with the sheet convey speed V. Specifically, the predetermined time Ts is equivalent to a time obtained by dividing, by the sheet convey speed V, the difference between (a) a convey distance from the sheet feed starting point of one of the sheet feed trays 51 and 52 to the secondary transfer position 571 (see FIG. 1) and (b) a distance from the laser scanning position of the photosensitive drum 21 to the secondary transfer position 571 via the primary transfer position along the outer circumferential surface of the photosensitive drum 21 and the outer circumferential surface of the intermediary transfer belt 27.

Performing the image formation after the lapse of the predetermined time from the sheet feed start timing is in order to enable the image position of the document and the image forming position of the sheet S to match each other.

This time difference is the same in the conventional printer if the apparatus structure thereof is the same as the printer 1.

By performing the sheet feed and image formation at the above-described timings, the leading end of the unfixed image 100 reaches the entrance of the fixing nip 611 at the timing-NT1, as shown in FIG. 5. Consequently, the timing at which the temperature of the fixing nip 611 reaches the fixing temperature and the leading end of the image on the sheet reaches the fixing nip 611 coincide with each other.

Figure 5B:
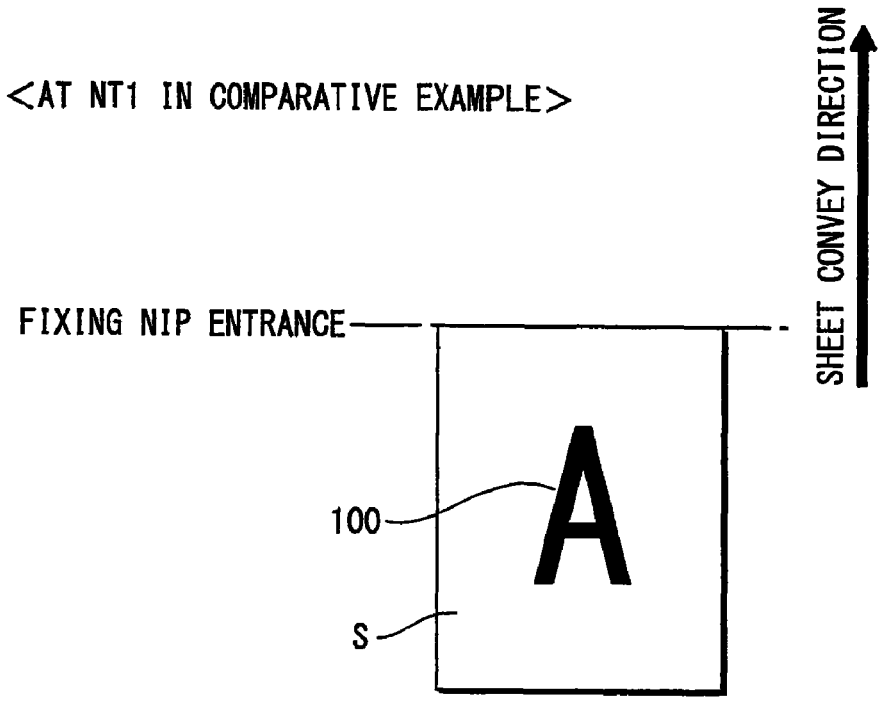

On the other hand, as shown in FIGS. 3 and 5B, the conventional printer (comparative example) starts feeding a sheet in a manner that the timing at which the temperature of the fixing nip reaches the fixing temperature (timing NT1) and the timing at which the leading end of the sheet reaches the entrance of the fixing nip match each other. This start timing corresponds to ST' in FIG. 3. If the conventional printer has the same apparatus structure as the present embodiment, the sheet feed is started later, by ΔT, than the sheet feed start timing (timing ST) of the present embodiment (embodiment). As a result, exit of the sheet from the fixing nip and the discharge of the printed sheet S are delayed accordingly. In FIG. 3, this exit timing is NT2' and the discharge timing is PT2'.

In other words, since the sheet feed start timing ST of the present embodiment is advanced by ΔT, compared to the comparative example, the timing NT2 at which the sheet exits from the fixing nip in the present embodiment is earlier, by ΔT, than the timing NT2' at which the sheet exits from the fixing nip in the comparative example. This shortens the fixing temperature maintenance time, reducing power consumption as a result. Also, the timing PT2 at which the sheet S is discharged to the discharge tray 59 in the present embodiment becomes earlier than the discharge timing PT2' in the comparative example. Consequently, the first print time from the reception of the print instruction from the user at the timing PT1 until the discharge of the first printed sheet S to the tray 59 can be shortened.

It should be noted that when the print job execution instruction instructs an execution of a multiple-sheet print job, because the sheet feed start timing ST of the first sheet is advanced, the timing NT2 at which the final sheet S exits from the fixing nip 611 and the timing PT2 at which the sheet S is discharged to the discharge tray 59 are advanced accordingly. Consequently, as is the case with a single-sheet print job, the power consumption and the print time from the reception of the print execution instruction until the discharge of the final sheet can be reduced compared to the conventional structure.

<Hysteresis Temperature Control>

As shown in FIG. 10, for the hysteresis temperature control in the present embodiment, a temperature range is preset. Here, the temperature range is −3 [° C.] to +2 [° C.] from a base temperature of either 180 [° C.] or 200 [° C.], and the temperature control is performed such that the temperature of the fixing nip 611 remains within the range. Specifically, the CPU 71 detects the temperature of the fixing part 6 using the temperature sensor 64 at a predetermined interval, for example, of 100 [ms], refers to the previously detected temperature of the fixing part 6 stored in the fixing part temperature storage 79 (FIG. 2), and compares the previously detected temperature and the currently detected temperature. If a comparison result indicates that the currently detected temperature of the fixing part 6 is higher than the previously detected temperature, the temperature of the fixing nip 611 is judged to be rising, and if the comparison result indicates that the currently detected temperature of the fixing part 6 is lower than the previously detected temperature, the temperature of the fixing nip 611 is judged to be falling. Also, it is judged if the currently detected temperature of the fixing nip 611 is (a) within the preset temperature range, (b) above the upper limit of the preset temperature range, or (c) below the lower limit of the preset temperature range. In the case where the currently detected temperature of the fixing nip 611 is within the preset temperature range, (a) if the temperature of the fixing nip 611 is judged to be rising (timings TH1 to TH2, TH3 to TH4, and TH5 to TH6), the heater 63 is turned OFF, and (b) if the temperature of the fixing nip 611 is judged to be falling (timings TH2 to TH3 and TH4 to TH5), the heater 63 is turned ON. In the case where the currently detected temperature of the fixing nip 611 is below the lower limit of the preset temperature range, the above-described predetermined temperature control is performed (timing TH0 to TH1), and in the case where the currently detected temperature of the fixing nip 611 is above the upper limit of the preset temperature range, the heater 63 is turned OFF forcibly (not depicted). Here, depending on whether the previously detected temperature of the fixing nip 611 is on the lower limit side or on the higher limit side of the set temperature, the voltage applied to the heater 63 is changed, thereby appropriately changing the variance of the temperature of the fixing nip 611.

The temperature change of the fixing nip 611 is indicated as a straight line in hysteresis temperature control sections (prior to the timing PT1 and the timing from NT1 to NT2) in FIG. 3. However, in a microscopic view, the temperature change of the fixing nip 611 fluctuates within the preset temperature range, as shown-in FIG. 10.

Second Embodiment

In the first embodiment, the period of time corresponding to a sheet convey time (to be described later) is calculated when the estimated fixing nip arrival time Ta is determined. In the present embodiment, the sheet convey time is pre-stored as information, and the present embodiment differs from the first embodiment in this aspect. In the following, description is given on the second embodiment, focusing on its difference from the first embodiment.

Figure 11:
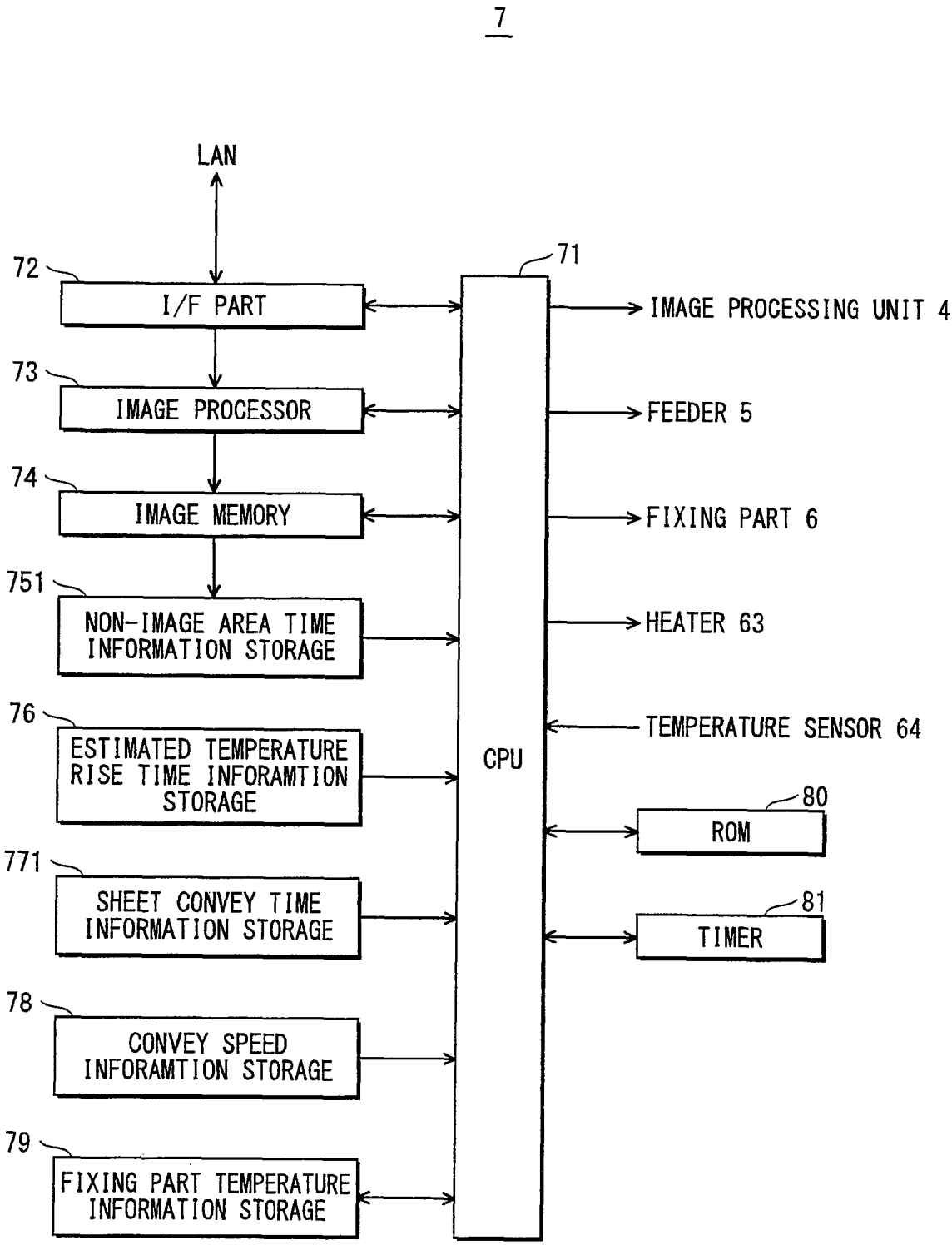
FIG. 11 is a block diagram showing a structure of a controller of a second embodiment.

As shown in FIG. 11, the controller 7 of the present embodiment differs from that of the first embodiment in including an non-image area time information storage 751 and a convey time information storage 771 instead of the non-image area distance information storage 75 and sheet convey distance information storage 77 of the first embodiment, respectively. Note that since other structures are the same as those of the first embodiment, the same reference numbers are assigned to the same structure components and description thereof is omitted to avoid repetition.

The non-image area time information storage 751 stores non-image area time information indicating a time TP (hereinafter, referred to as "non-image area convey time Tp") which is a period of time required for the sheet S to be conveyed a distance equivalent to the non-image area distance Lp (see FIG. 5A). The non-image area convey time Tp varies depending on the potision of the image formed on the sheet from the leading end of the sheet. The non-image area convey time Tp also varies depending on the kind of the sheet S, since the sheet convey speed varies according to the kind of the selected sheet S. Accordingly, the non-image area time information associates in advance, for each kind of the sheet S, for example, the non-image area distances Lp indicated in units of mm with the non-image area convey times Tp on one-to-one basis.

The sheet convey time information storage 771 stores time information indicating a time T (hereinafter, referred to as "sheet convey time T") required for the sheet S to be conveyed from the respective feed starting points in a vicinity of the feeding rollers 53 and 54 of the feeder 5 to the entrance of the fixing nip 611 of the fixing part 6, respectively. As is the case with the non-image area convey time Tp, the sheet convey time T varies depending on the kind of the sheet because the sheet convey speed varies depending on the kind of the selected sheet S. Accordingly, the sheet convey time T also varies depending on the kind of the selected sheet S. The sheet convey time T can be calculated in advance based on the kind of the sheet S and the sheet convey distances L1 and L3, and is associated, for each of the sheet feed trays 51 and 52, with the kind of the sheet S.

Figure 12:
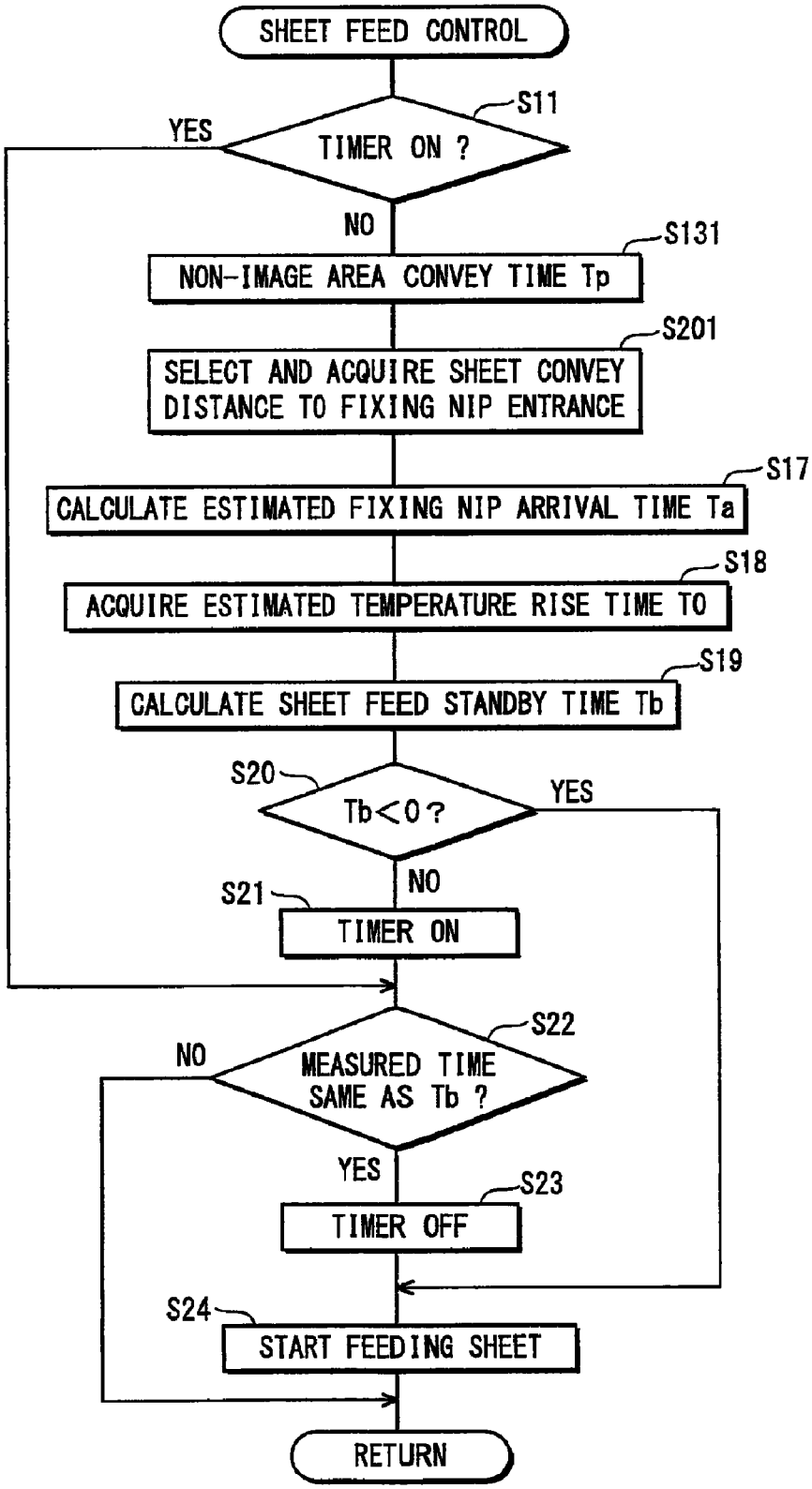
FIG. 12 is a flowchart showing an exemplary content of a sheet feed control of the second embodiment.

The sheet feed control of the present embodiment is shown in FIG. 12. In the figure, the same steps as those in the first embodiment are assigned the same reference numbers, and description thereof is omitted to avoid repetition.

As shown in FIG. 12, the non-image area convey time Tp is acquired (step S131). Specifically, processing that is the same as the processing up to the step S29 in the non-image area distance detection processing (FIG. 7) performed in the first embodiment is performed, and after the step S29, the non-image area convey time Tp corresponding to the detected non-image area distance Lp is acquired by referring to the non-image area time information storage 751. The sheet convey time T to the entrance of the fixing nip 611 is selected and acquired in accordance with the sheet S selected in the print job execution instruction (step S141), and the estimated fixing nip arrival time Ta is obtained by adding the acquired non-image area convey time Tp and the sheet convey time T (step S17).

As described above, calculation of the estimated fixing nip arrival time Ta also allows reduction in the load on the CPU71 as well as reducing the power consumption and first print time.

<Modifications>

(1) According to the above-described embodiments, upon reception of a print job execution instruction, the printer starts the temperature-raising first, and after that or substantially at the same time, starts the sheet feed. However, for example, the printer can be configured to start the sheet feed first and start the temperature-raising after that, as long as the timing at which the temperature of the fixing nip reaches the fixing temperature and the timing at which the leading end of the image in the sheet convey direction on the sheet reaches the entrance of the nip match each other. With such an apparatus configuration, the printer calculate (a) a time T1 which is a period of time required for the temperature of the fixing nip to reach the fixing temperature from the current temperature, (b) a time T2 which is a period of time, from the start of the sheet feed, for the leading end of the image in the sheet convey direction on the sheet to reach the entrance of the fixing nip, and (c) a time difference between the time T1 and time T2. After that, the printer starts the temperature-raising upon a lapse of a period of time equivalent to the time difference after the start of the sheet feed.

(2) According to the above-described embodiments, the sheet feed start timing precedes the image formation start timing. However, depending the apparatus configuration, the image formation start timing may precede the sheet feed start timing. In such a case, the sheet feed operation is performed in conjunction with the image forming operation such that the sheet feed is started upon a lapse of a predetermined time after the start of the image formation.

(3) According to the above-described embodiments, the fixing part 6 is a roller nip. However, not limited to this, a fixing part of a belt nip type or the like can be used.

(4) According to the above-described embodiments, in the temperature control of the fixing part 6, the standby temperature is 180 [° C.] and the fixing temperature is 200 [° C.]. However, these temperature are obviously not limited these values. Also, while, according to the above-described embodiments, the control is performed to maintain the temperature of the fixing nip at the standby temperature, this control may not be performed.

(5) According to the above-described embodiments, the feeder 5 includes two sheet feed trays. However, not limited to this, the feeder 5 can include only one sheet feed tray. In this case, the sheet convey distance information storage 77 stores one piece of distance information, and the sheet convey time storage 771 stores multiple pieces of sheet convey time information which are calculated based on multiple sheet convey speeds V determined in accordance with the one distance and the kind of the sheet S. Of course, the feeder 5 can include three or more sheet feed trays.

(6) The above-described embodiments are described on an assumption that the sheet feed trays 51 and 52 accommodate mutually different sheets S. However, not limited to this, the sheet feed trays 51 and 52 can accommodate the same kind of sheets S.

(7) The above-described embodiments describe an example where the present invention is applied to a tandem-type color digital printer using an intermediate transfer method. However, not limited to this, the present invention can be applied to that of a so-called direct transfer method which directly transfers the toner images from the photosensitive drum onto the sheet, or can be applied to that of a so-called rotary type which accommodates image forming units for the respective colors in a rotary-type apparatus. Further, the present invention can be applied to an image forming apparatus such as a copier, a FAX, a MFP (Multiple Function Peripheral) or the like regardless of whether the image formation is performed in color or monochrome, as long as the image forming apparatus raises the temperature of the fixing nip secured at the fixing part and thermally fixes an image on a recording sheet by passing the recording sheet which has the image formed thereon through the fixing nip.

Also, the present invention may be any combination of the above embodiment and the variations.

Furthermore, the present invention may be a program for executing the image forming method on a computer. Also, the program pertaining to the present invention may be recorded to magnetic tape, a magnetic disk such as a flexible disk, an optical recording medium such as DVD-ROM, DVD-RAM, CD-ROM, CD-R, MO, or PD, or a computer-readable recording medium such as a flash-memory-type recording memory. The program may be produced and transferred in the form of the recording medium, and may also be transferred or distributed via telecommunication lines, radio communications, communication lines, or a network such as the Internet.

(8) Conclusion

The above-described embodiments and modifications indicate one aspect for solving the problem described in the Related Art section, and these embodiments and modifications can be summarized as follows.

The image forming apparatus of the present invention is an image forming apparatus comprising: an image former operable to, upon receiving a first instruction, feed a sheet and perform an image forming operation so as to form an image on the fed sheet; a fixing part operable to (i) secure a fixing nip by bringing an outer circumferential surface of a first rotating body and an outer circumferential surface of a second rotating body into contact with each other, (ii) upon receiving a second instruction, heat at least one of the first and second rotating bodies until a temperature of the first and second rotating bodies reaches a target temperature required for image-fixing, and (iii) thermally fix the image onto the sheet passing through the fixing nip; and a determiner operable to determine an output timing of the first instruction and an output timing of the second instruction such that a timing at which a leading end, in a sheet convey direction, of the image formed on the sheet reaches the fixing nip and a timing at which the temperature of the first and second rotating bodies reaches the target temperature match each other.

The image former may include a feeder operable to, upon receiving the first instruction, start feeding of the sheet from a feed starting point, the image former executes the image forming operation with respect to the fed sheet in conjunction with the feeding of the sheet, the determiner includes: an acquirer operable to acquire information indicating a time T0 and a time Ta, the time T0 being a period of time estimated to be required for the temperature of the first and second rotating bodies to reach the target temperature, and the time Ta being a period of time estimated to be required, from the start of the feeding of the sheet, for the leading end of the image formed on the sheet to reach the fixing nip, and the determiner, if the time T0 is equal to or greater than the time Ta, outputs the first instruction when a period of time equivalent to a difference between the times T0 and Ta has elapsed after outputting the second instruction.

With the stated structure, when the time T0≧ the time Ta, the image forming apparatus determines the timing at which to start the feeding of the sheet to be when the time equivalent to the time difference between the times T0 and Ta has elapsed after outputting the second instruction. Compared to the conventional structure where the timing at which the temperature of the fixing nip reaches the fixing temperature and the timing at which the leading end of the sheet in the convey direction reaches the fixing nip match each other, the stated structure shortens the time from the output of the second instruction to the sheet feed starting timing by a period of time corresponding to the non-image area, thereby allowing the sheet feed starting timing to be brought forward. In the case where the image forming apparatus is configure to stop heating the rotating bodies when the rear end of the sheet exits from the fixing nip, because the sheet feed start timing is brought forward, the sheet exits from the fixing nip earlier accordingly, compared to the convention structure. Consequently, the rotating bodies are maintained at the fixing temperature for a shorter period of time, suppressing the power consumption required for the heating as a result. Further, since the sheet, with respect to which the thermal fixing has been completed, is discharged earlier, the first print time can be shortened as well.

The determiner may further include: an adder operable to add a distance Lp and a distance L on an assumption that the image has been formed on the sheet, the distance Lp being a distance from a leading end of the sheet in the sheet convey direction to the leading end of the image, and the distance L being a distance of a sheet convey path to the fixing nip from the feed starting point used for the feeding of the sheet; and a calculator operable to calculate the time Ta based on (a) a distance La obtained as a result of the addition and (b) a sheet convey speed V.

With the stated structure, the image forming apparatus can start the sheet feed earlier by the distance Lp corresponding to the non-image area.

The feeder may be configured to be able to feed any one of different kinds of sheets sheet by sheet, the sheet convey speed V varies according to a kind of the fed sheet, and the calculator uses the sheet convey speed V corresponding to the fed sheet when calculating the time Ta.

With the stated structure, the image forming apparatus can determine the sheet feed start timing according to the kind of the sheet even if any one of the different kinds of sheets is fed.

The feeder may include one or more feed starting points in addition to the feed starting point, all the feed starting points having mutually different distances to the fixing nip, and the adder uses, as the distance L, a distance corresponding to one out of all feed starting points which is actually used for the feeding of the sheet, and adds the distance Lp to the distance L.

With the stated structure, the image forming apparatus can determine the sheet feed start timing according to the feed starting points even if there are more than one feed starting points which have mutually different distances to the fixing nip.

The determiner may further include: an acquirer operable to acquire information indicating a time Tp and a time T on an assumption that the image has been formed on the sheet, the time Tp being a period of time estimated to be required for the sheet to be conveyed a distance equivalent to a distance from a leading end, in the sheet convey direction, of the sheet to the leading end of the image, and the time T being a period of time estimated to be required for the sheet to be conveyed a distance equivalent to a distance of a sheet convey path to the fixing nip from the feed starting point used for the feeding of the sheet; and a calculator operable to calculate the time Ta based on the times Tp and T.

With the stated structure, the image forming apparatus can start the sheet feed earlier by the time Tp corresponding to the non-image area.

The feeder may be configured to be able to feed any one of different kinds of sheets sheet by sheet, the times Tp and T vary according to a kind of the fed sheet, and the calculator uses the times Tp and T corresponding to the fed sheet when calculating the time Ta.

With the stated structure, the image forming apparatus can determine the sheet feed start timing according to the kind of the sheet even if any one of the different kinds of sheets is fed.

The feeder may include one or more feed starting points in addition to the feed starting point, all the feed starting points having mutually different distances to the fixing nip, the time T varies according to the feed starting point currently used for the feeding of the sheet, and the calculator uses the time T corresponding to the feed starting point currently used for the feeding of the sheet to calculate the time Ta.

With the stated structure, the image forming apparatus can determine the sheet feed start timing according to the feed starting points even if there are more than one feed starting points which have mutually different distances to the fixing nip.

The determiner may further include: a receiver operable to receive a start instruction of an image formation, and the determiner, upon receiving the start instruction, (i) outputs the second instruction, and (ii) if the time T0 is less than the time Ta, outputs the first instruction immediately after the second instruction, irrespective of whether or not the timing at which the leading end of the image reaches the fixing nip and the timing at which the temperature of the first and second rotating bodies reaches the target temperature match each other.

With the stated structure, the image forming apparatus can feed the sheet even in a case where the assumed relationship between T0 and Ta is T0<Ta theoretically.

As one aspect of the image forming method of the present invention, the image forming step may include a feeding step of, upon receiving the first instruction, starting feeding of the sheet from a feed starting point provided to the image forming apparatus, the image forming step executes the image forming operation with respect to the fed sheet in conjunction with the feeding of the sheet, the determining step includes an acquiring step of acquiring information indicating a time T0 and a time Ta, the time T0 being a period of time estimated to be required for the temperature of the first and second rotating bodies to reach the target temperature, and the time Ta being a period of time estimated to be required, from the start of the feeding of the sheet, for the leading end of the image formed on the sheet to reach the fixing nip, and the determining step, if the time T0 is equal to or greater than the time Ta, outputs the first instruction when a period of time equivalent to a difference between the times T0 and Ta has elapsed after outputting the second instruction.

With the stated structure, when the time T0≧ the time Ta, the timing at which to start the feeding of the sheet is determined to be when the time equivalent to the time difference between the times T0 and Ta has elapsed after outputting the second instruction. Compared to the conventional structure where the timing at which the temperature of the fixing nip reaches the fixing temperature and the timing at which the leading end of the sheet in the convey direction reaches the fixing nip match each other, the stated structure shortens the time from the output of the second instruction to the sheet feed starting timing by a period of time corresponding to the non-image area, thereby allowing the sheet feed starting timing to be brought forward. In the case of a structure which stops heating the rotating bodies when the rear end of the sheet exits from the fixing nip, because the sheet feed start timing is brought forward, the sheet exits from the fixing nip earlier accordingly, compared to the convention structure. Consequently, the rotating bodies are maintained at the fixing temperature for a shorter period of time, suppressing the power consumption required for the heating as a result. Further, since the sheet, with respect to which the thermal fixing has been completed, is discharged earlier, the first print time can be shortened as well.

The determining step may further include: an adding step of adding a distance Lp and a distance L on an assumption that the image has been formed on the sheet, the distance Lp being a distance from a leading end of the sheet in the sheet convey direction to the leading end of the image, and the distance L being a distance of a sheet convey path to the fixing nip from the feed starting point used for the feeding of the sheet; and a calculating step of calculating the time Ta based on (a) a distance La obtained as a result of the addition and (b) a sheet convey speed V.

With the stated structure, the sheet feed can be started earlier by the distance Lp corresponding to the non-image area.

The feeding step may feed any one of different kinds of sheets sheet by sheet, the sheet convey speed V varies according to a kind of the fed sheet, and the calculating step uses the sheet convey speed V corresponding to the fed sheet when calculating the time Ta.

With the stated structure, the sheet feed start timing can be determined according to the kind of the sheet even if any one of the different kinds of sheets is fed.

The image forming apparatus may include one or more feed starting points in addition to the feed starting point, all the feed starting points having mutually different distances to the fixing nip, and the adding step uses, as the distance L, a distance corresponding to one out of all the feed starting points which is actually used for the feeding of the sheet, and adds the distance Lp to the distance L.

With the stated structure, the sheet feed start timing can be determined according to the feed starting points even if there are more than one feed starting points which have mutually different distances to the fixing nip.

The determining step may further include: an acquiring step of acquiring information indicating a time Tp and a time T on an assumption that the image has been formed on the sheet, the time Tp being a period of time estimated to be required for the sheet to be conveyed a distance equivalent to a distance from a leading end, in the sheet convey direction, of the sheet to the leading end of the image, and the time T being a period of time estimated to be required for the sheet to be conveyed a distance equivalent to a distance of a sheet convey path to the fixing nip from the feed starting point used for the feeding of the sheet; and a calculating step of calculating the time Ta based on the times Tp and T.

With the stated structure, the sheet feed can be started earlier by the time Tp corresponding to the non-image area.

The feeding step may feed any one of different kinds of sheets sheet by sheet, the times Tp and T vary according to a kind of the fed sheet, and the calculating step uses the times Tp and T corresponding to the fed sheet when calculating the time Ta.

With the stated structure, the sheet feed start timing can be determined according to the kind of the sheet even if any one of the different kinds of sheets is fed.

The image forming apparatus may include one or more feed starting points in addition to the feed starting point, all the feed starting points having mutually different distances to the fixing nip, the time T varies according to the feed starting point currently used for the feeding of the sheet, and the calculating step uses the time T corresponding to the feed starting point currently used for the feeding of the sheet to calculate the time Ta.

With the stated structure, the sheet feed start timing can be determined according to the feed starting points even if there are more than one feed starting points which have mutually different distances to the fixing nip.

The determining step may further include a receiving step of receiving a start instruction of an image formation, and the determining step, upon receiving the start instruction, (i) outputs the second instruction, and (ii) if the time T0 is less than the time Ta, outputs the first instruction immediately after the second instruction, irrespective of whether or not the timing at which the leading end of the image reaches the fixing nip and the timing at which the temperature of the first and second rotating bodies reaches the fixing temperature match each other.

With the stated structure, the sheet can be fed even in a case where the assumed relationship between T0 and Ta is T0<Ta theoretically.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image former operable to, upon receiving a first instruction, feed a sheet and perform an image forming operation so as to form an image on the fed sheet;

a fixing part operable to (i) secure a fixing nip by bringing an outer circumferential surface of a first rotating body and an outer circumferential surface of a second rotating body into contact with each other, (ii) upon receiving a second instruction, heat at least one of the first and second rotating bodies until a temperature of the first and second rotating bodies reaches a target temperature required for image-fixing, and (iii) thermally fix the image onto the sheet passing through the fixing nip; and a determiner operable to determine an output timing of the first instruction and an output timing of the second instruction such that a timing at which a leading end, in a sheet convey direction, of the image formed on the sheet reaches the fixing nip and a timing at which the temperature of the first and second rotating bodies reaches the target temperature match each other.

2. The image forming apparatus of claim 1, wherein the image former includes:

a feeder operable to, upon receiving the first instruction, start feeding of the sheet from a feed starting point, the image former executes the image forming operation with respect to the fed sheet in conjunction with the feeding of the sheet, the determiner includes:

an acquirer operable to acquire information indicating a time T0 and a time Ta, the time T0 being a period of time estimated to be required for the temperature of the first and second rotating bodies to reach the target temperature, and the time Ta being a period of time estimated to be required, from the start of the feeding of the sheet, for the leading end of the image formed on the sheet to reach the fixing nip, and the determiner, if the time T0 is equal to or greater than the time Ta, outputs the first instruction when a period of time equivalent to a difference between the times T0 and Ta has elapsed after outputting the second instruction.

3. The image forming apparatus of claim 2, wherein the determiner further includes:

an adder operable to add a distance Lp and a distance L on an assumption that the image has been formed on the sheet, the distance Lp being a distance from a leading end of the sheet in the sheet convey direction to the leading end of the image, and the distance L being a distance of a sheet convey path to the fixing nip from the feed starting point used for the feeding of the sheet; and a calculator operable to calculate the time Ta based on (a) a distance La obtained as a result of the addition and (b) a sheet convey speed V.

4. The image forming apparatus of claim 3, wherein the feeder is configured to be able to feed any one of different kinds of sheets, sheet by sheet, the sheet convey speed V varies according to a kind of the fed sheet, and the calculator uses the sheet convey speed V corresponding to the fed sheet when calculating the time Ta.

5. The image forming apparatus of claim 3, wherein the feeder includes one or more feed starting points in addition to the feed starting point, all the feed starting points having mutually different distances to the fixing nip, and the adder uses, as the distance L, a distance corresponding to one out of all the feed starting points which is actually used for the feeding of the sheet, and adds the distance Lp to the distance L.

6. The image forming apparatus of claim 2, wherein the determiner further includes:

an acquirer operable to acquire information indicating a time Tp and a time T on an assumption that the image has been formed on the sheet, the time Tp being a period of time estimated to be required for the sheet to be conveyed a distance equivalent to a distance from a leading end, in the sheet convey direction, of the sheet to the leading end of the image, and the time T being a period of time estimated to be required for the sheet to be conveyed a distance equivalent to a distance of a sheet convey path to the fixing nip from the feed starting point used for the feeding of the sheet; and a calculator operable to calculate the time Ta based on the times Tp and T.

7. The image forming apparatus of claim 6, wherein the feeder is configured to be able to feed any one of different kinds of sheets, sheet by sheet, the times Tp and T vary according to a kind of the fed sheet, and the calculator uses the times Tp and T corresponding to the fed sheet when calculating the time Ta.

8. The image forming apparatus of claim 6, wherein the feeder includes one or more feed starting points in addition to the feed starting point, all the feed starting points having mutually different distances to the fixing nip, the time T varies according to the feed starting point currently used for the feeding of the sheet, and the calculator uses the time T corresponding to the feed starting point currently used for the feeding of the sheet to calculate the time Ta.

9. The image forming apparatus of claim 2, wherein the determiner further includes:

a receiver operable to receive a start instruction of an image formation, and the determiner, upon receiving the start instruction, (i) outputs the second instruction, and (ii) if the time T0 is less than the time Ta, outputs the first instruction immediately after the second instruction, irrespective of whether or not the timing at which the leading end of the image reaches the fixing nip and the timing at which the temperature of the first and second rotating bodies reaches the target temperature match each other.

10. An image forming method executed by an image forming apparatus including an image former and a fixing part which secures a fixing nip by bringing an outer circumferential surface of a first rotating body and an outer circumferential surface of a second rotating body into contact with each other and thermally fixes an image onto a sheet passing the through the fixing nip, the image forming method comprising:

an image forming step of, upon receiving a first instruction, feeding a sheet and performing an image forming operation so as to form the image on the fed sheet;

a temperature raising step of, upon receiving a second instruction, heating at least one of the first and second rotating bodies using the heater until a temperature of the first and second rotating bodies reaches a target temperature required for image-fixing; and a determining step of determining an output timing of the first instruction and an output timing of the second instruction such that a timing at which a leading end, in a sheet convey direction, of the image formed on the sheet reaches the fixing nip and a timing at which a temperature of the first and second rotating bodies reaches the target temperature match each other.

11. The image forming method of claim 10, wherein the image forming step includes:

a feeding step of, upon receiving the first instruction, starting feeding of the sheet from a feed starting point provided to the image forming apparatus, the image forming step executes the image forming operation with respect to the fed sheet in conjunction with the feeding of the sheet, the determining step includes:

an acquiring step of acquiring information indicating a time T0 and a time Ta, the time T0 being a period of time estimated to be required for the temperature of the first and second rotating bodies to reach the target temperature, and the time Ta being a period of time estimated to be required, from the start of the feeding of the sheet, for the leading end of the image formed on the sheet to reach the fixing nip, and the determining step, if the time T0 is equal to or greater than the time Ta, outputs the first instruction when a period of time equivalent to a difference between the times T0 and Ta has elapsed after outputting the second instruction.

12. The image forming method of claim 11, wherein the determining step further includes:

an adding step of adding a distance Lp and a distance L on an assumption that the image has been formed on the sheet, the distance Lp being a distance from a leading end of the sheet in the sheet convey direction to the leading end of the image, and the distance L being a distance of a sheet convey path to the fixing nip from the feed starting point used for the feeding of the sheet; and a calculating step of calculating the time Ta based on (a) a distance La obtained as a result of the addition and (b) a sheet convey speed V.

13. The image forming method of claim 12, wherein the feeding step feeds any one of different kinds of sheets, sheet by sheet, the sheet convey speed V varies according to a kind of the fed sheet, and the calculating step uses the sheet convey speed V corresponding to the fed sheet when calculating the time Ta.

14. The image forming method of claim 12, wherein the image forming apparatus includes one or more feed starting points in addition to the feed starting point, all the feed starting points having mutually different distances to the fixing nip, and the adding step uses, as the distance L, a distance corresponding to one out of all the feed starting points which is actually used for the feeding of the sheet, and adds the distance Lp to the distance L.

15. The image forming method of claim 11, wherein the determining step further includes:

an acquiring step of acquiring information indicating a time Tp and a time T on an assumption that the image has been formed on the sheet, the time Tp being a period of time estimated to be required for the sheet to be conveyed a distance equivalent to a distance from a leading end, in the sheet convey direction, of the sheet to the leading end of the image, and the time T being a period of time estimated to be required for the sheet to be conveyed a distance equivalent to a distance of a sheet convey path to the fixing nip from the feed starting point used for the feeding of the sheet; and a calculating step of calculating the time Ta based on the times Tp and T.

16. The image forming method of claim 15, wherein the feeding step feeds any one of different kinds of sheets, sheet by sheet, the times Tp and T vary according to a kind of the fed sheet, and the calculating step uses the times Tp and T corresponding to the fed sheet when calculating the time Ta.

17. The image forming method of claim 15, wherein the image forming apparatus includes one or more feed starting points in addition to the feed starting point, all the feed starting points having mutually different distances to the fixing nip, the time T varies according to the feed starting point currently used for the feeding of the sheet, and the calculating step uses the time T corresponding to the feed starting point currently used for the feeding of the sheet to calculate the time Ta.

18. The image forming method of claim 11, wherein the determining step further includes:

a receiving step of receiving a start instruction of an image formation, and the determining step, upon receiving the start instruction, (i) outputs the second instruction, and (ii) if the time T0 is less than the time Ta, outputs the first instruction immediately after the second instruction, irrespective of whether or not the timing at which the leading end of the image reaches the fixing nip and the timing at which the temperature of the first and second rotating bodies reaches the fixing temperature match each other.

* * * * *